US009914129B2

(12) United States Patent
Clint et al.

(10) Patent No.: US 9,914,129 B2
(45) Date of Patent: Mar. 13, 2018

(54) MOUNTING OF WEAR PARTS FOR VERTICAL SHAFT IMPACT CRUSHERS

(71) Applicant: Metso Minerals, Inc., Helsinki (FI)

(72) Inventors: Hackworth Clint, Huntly (NZ); Chandrasekaran Prem, Auckland (NZ); Omundsen Shane, Cambridge (NZ); Dew Joseph, Wanganui (NZ)

(73) Assignee: Metso Minerals, Inc., Helsinki (FI)

( * ) Notice: Subject to any disclaimer, the term of this patent is extended or adjusted under 35 U.S.C. 154(b) by 617 days.

(21) Appl. No.: 14/386,607

(22) PCT Filed: Mar. 25, 2013

(86) PCT No.: PCT/FI2013/050332
§ 371 (c)(1),
(2) Date: Sep. 19, 2014

(87) PCT Pub. No.: WO2013/140049
PCT Pub. Date: Sep. 26, 2013

(65) Prior Publication Data

US 2015/0048191 A1 Feb. 19, 2015

(30) Foreign Application Priority Data

Mar. 23, 2012 (NZ) ..... 598990

(51) Int. Cl.
*B02C 13/18* (2006.01)
*B02C 13/28* (2006.01)

(52) U.S. Cl.
CPC ..... *B02C 13/1835* (2013.01); *B02C 13/2804* (2013.01); *B02C 2013/2808* (2013.01); *Y10T 29/49959* (2015.01)

(58) Field of Classification Search
CPC ..... B02C 13/1835; B02C 13/2804; B02C 2013/2808; Y10T 29/49959
(Continued)

(56) References Cited

U.S. PATENT DOCUMENTS 3,767,127 A 10/1973 Wood
3,873,047 A 3/1975 Johnson
(Continued)

FOREIGN PATENT DOCUMENTS

EP 0562194 A2 9/1993
NZ 297910 5/1998

OTHER PUBLICATIONS

New Zealand Examination Report dated Mar. 27, 2012 (NZ Application No. 598990).
(Continued)

*Primary Examiner* — Shelley Self
*Assistant Examiner* — Joseph Finan, Jr.
(74) *Attorney, Agent, or Firm* — Andrus Intellectual Property Law, LLP

(57) ABSTRACT

This invention relates to a wear part for the rotor of a rock crusher, the rotor including at least one outlet port, and a mounting bar, wherein the wear part is configured to engage with the mounting bar, the wear part including: a body having an upper surface and a lower surface, the body also including a surface configured to abut against the outlet port, characterized in that the wear part is configured with a channel having substantially an U-shaped cross section running between the upper surface and the lower surface of the body, the channel having a mouth and a location portion, wherein the locating portion is complementary to the width of the mounting bar; wherein the exterior surface of the bottom portion of the U-shaped cross section includes a lateral projection and abuts the outlet port in use.

12 Claims, 11 Drawing Sheets

(58) Field of Classification Search
USPC ..... 241/275
See application file for complete search history.

(56) References Cited

U.S. PATENT DOCUMENTS

| | | | | |
|---|---|---|---|---|
| 5,381,976 | A | 1/1995 | Chon et al. | |
| 7,427,042 | B2 * | 9/2008 | Rodriguez | B02C 13/2804 241/275 |
| 2005/0150987 | A1 | 7/2005 | Hur et al. | |

OTHER PUBLICATIONS

PCT International Search Report issued in PCT Application No. PCT/FI2013/050332 dated Jul. 30, 2013.
PCT Written Opinion issued in PCT Application No. PCT/FI2013/050332 dated Jul. 30, 2013.

* cited by examiner

MOUNTING OF WEAR PARTS FOR VERTICAL SHAFT IMPACT CRUSHERS

CROSS REFERENCE TO RELATED APPLICATION

This application is a U.S. National Phase Application, claiming priority to PCT International Application No. PCT/FI2013/050332, filed on Mar. 25, 2013 and published on Sep. 26, 2013 as PCT Publication No. WO 2013/140049, which claims priority to New Zealand Patent Application No. 598990, filed on Mar. 23, 2012.

TECHNICAL FIELD

The invention relates to improvements in the mounting of wear parts for vertical shaft impact crushers. The invention has particular application to the mounting of the rotor tips of a rotor for a vertical shaft impact rock crusher.

BACKGROUND ART

A Vertical Shaft Impact (VSI) crusher is a particular type of crusher that is used in the production of aggregate.

A VSI crusher includes a rotor configured to rotate within a crushing chamber at high speeds about a vertical axis. Rock material enters the rotor by an inlet port and, as the rotor spins, is ejected from the rotor via outlet ports arranged about the circumference of the rotor and is hurled against anvils placed strategically about the chamber or the rock lined shell of the crusher chamber.

The impact forces breaks down the ejected rock material into aggregate. A crusher which uses this mode of breaking down rock material is sometimes known as a "rock on rock" crusher.

Some VSI crushers create impact forces by ejecting rock material from the rotor into a cascade of rock material that falls past the outlet ports of the rotor. An example of such a crusher is described in New Zealand Patent No. 297910.

Regardless of the mode of action of the rock crusher, the rotor body and its constituent components are exposed to considerable wear and tear due to the impact of the rock material entering the rotor, and the speeds at which the rotor operates.

A conventional VSI rotor consists of a one piece steel fabricated rotor body. The body includes an inlet port, outlet ports, a base plate and a top plate. The various outlet ports are formed by bolting or welding vertical members between the top and base plates. The rotor body is then protected by a number of wear resistant castings fixed about the rotor using a variety of methods.

It is not uncommon to have over 40 wear resistant components, or wear parts, protecting the rotor body. Many of these are what are referred to in the industry as rotor tips or cavity wear plates. The rotor tips are often placed at the exit of the outlet ports of the rotor body. It is usually these wear parts which experience the greatest wear and tear.

Such wear parts are typically attached to the rotor through the use of bolts or similar fasteners. These fasteners are often subject to wear and tear, and can become hard to remove. This can prolong the time the rotor is offline for maintenance.

For particularly difficult fasteners, it may be necessary to use cutting tools to allow the wear parts to be replaced. This introduces additional health and safety risks for the person using the cutting tool. This can also add to the time required for maintenance of the rotor.

In order to replace the rotor tips or cavity wear plates, it is often necessary to partially dissemble the rotor body by removing other rotor wear parts. This is a cumbersome and time consuming task.

Despite the provision of doors on the crushing chamber, it is usually still necessary to remove the roof of the crusher in order to gain access to the rotor body and allow the disassembly of the rotor body.

In order to achieve the necessary maintenance of the crusher, it must be shut down. VSI crushers are significant items of machinery, processing large amounts of rock material. The running costs of such VSI crushers can be particularly significant. Because of the expenditure associated with the purchase of crushers, and their running costs, operators tend to maximise their use where possible.

Thus, it is undesirable to have a VSI crusher offline for extended periods of time in order to fulfill maintenance requirements. The downtime of a crusher can have an impact on the throughput of the facility in which the crusher is installed. If the VSI crusher does need to be offline, then the downtime should be preferably kept to a minimum.

Furthermore, significant disassembly of the rotor often requires several persons and heavy lifting equipment in order to remove the roof and possibly other components of the crusher. This is not ideal and is not conducive to keeping maintenance costs to a minimum.

VSI crushers are also used in mineral material processing plants, such as mobile crushing plants, which combine the crusher with a feeding device, such as a conveyor or hopper, on a heavy vehicle. When replacing wear parts on these crushers, not only does the rotor body of the crusher have to partially disassembled but it is often necessary to remove the surrounding ancillary equipment as well. This extends the overall time required to replace the wear part.

It is an object of the present invention to address the foregoing problems or at least to provide the public with a useful choice.

Further aspects and advantages of the present invention will become apparent from the ensuing description which is given by way of example only.

All references, including any patents or patent applications cited in this specification are hereby incorporated by reference. No admission is made that any reference constitutes prior art. The discussion of the references states what their authors assert, and the applicants reserve the right to challenge the accuracy and pertinency of the cited documents. It will be clearly understood that, although a number of prior art publications may be referred to herein, this reference does not constitute an admission that any of these documents form part of the common general knowledge in the art, in New Zealand or in any other country.

It is acknowledged that the term 'comprise' may, under varying jurisdictions, be attributed with either an exclusive or an inclusive meaning. For the purpose of this specification, and unless otherwise noted, the term 'comprise' shall have an inclusive meaning—i.e. that it will be taken to mean an inclusion of not only the listed components it directly references, but also other non-specified components or elements. This rationale will also be used when the term 'comprised' or 'comprising' is used in relation to one or more steps in a method or process.

DISCLOSURE OF THE INVENTION

According to one aspect of the present invention, there is provided a wear part for the rotor of a rock crusher, the rotor including an inlet port, a top plate and a bottom plate and at least one outlet port between the plates, and a mounting bar configured to engage with at least one of the plates, the wear part including a body having an upper surface and a lower surface, the body also including an exterior surface, characterised in that the wear part is configured with a channel running between the upper surface and the lower surface of the body, the channel having a mouth and a locating portion, wherein the locating portion is complementary to the width of the mounting bar, and wherein the exterior surface of the body is configured to abut a substantially vertical surface of the outlet port such that, in use, the mouth of the wear part faces substantially away from the inlet port.

According to another aspect of the present invention, there is provided a mounting bar for the rotor of a rock crusher, the rotor including an inlet port, a top plate and a bottom plate and at least one outlet port between the plates, wherein the mounting bar is for use with a wear part for the rock crusher, wherein the wear part has a body having an upper surface and a lower surface and is configured with a channel running between the upper surface and lower surface, the channel having a mouth and a locating portion, the body also including an exterior surface, the mounting bar characterised in that the cross-sectional area of the mounting bar is complementary to the cross-section of the locating portion of the channel of the wear part.

According to another aspect of the present invention, there is provided a rotor for a rock crusher, the rotor including an inlet port, a top plate and a bottom plate and at least one outlet port between the plates, a mounting bar for a wear part, at least one wear part, wherein the wear part has a body having an upper surface and a lower surface, the body also including an exterior surface, wherein the wear part is configured to engage with the mounting bar, characterised in that the wear part is configured with a channel running between the upper surface and the lower surface of the body, the channel having a mouth and a locating portion, wherein the locating portion is complementary to the width of the mounting bar, and wherein the exterior surface of the body abuts a substantially vertical surface of the outlet port such that, in use, the mouth of the wear part faces substantially away from the inlet port.

According to one aspect of the present invention, there is provided a rock crusher including a rotor, the rotor including an inlet port, a top plate and a bottom plate and at least one outlet port between the plates, a mounting bar for a wear part, at least one wear part, wherein the wear part has a body having an upper surface and a lower surface, the body also including an exterior surface, wherein the wear part is configured to engage with the mounting bar, characterised in that the wear part is configured with a channel running between the upper surface and the lower surface of the body, the channel having a mouth and a locating portion, wherein the locating portion is complementary to the width of the mounting bar, and wherein the exterior surface of the body abuts a substantially vertical surface of the outlet port such that, in use, the mouth of the wear part faces substantially away from the inlet port.

According to yet another aspect of the present invention there is provided a mineral material processing plant, wherein the plant includes a rock crusher substantially as described above.

The present invention provides apparatus and a method for the replacement of wear parts of a rotor body for a rock crusher.

The invention has particular application to a type of rock crusher known as a vertical shaft impact (VSI) crusher. However, persons skilled in the art will appreciate that with suitable modifications, the present invention may be used in other types of rock crushers, such as a horizontal shaft impact rock crusher.

A VSI crusher has a rotor which spins at high speed within a crushing chamber.

A rotor body should be understood to mean the part of the rotor which rotates at high speeds and includes at least one inlet port for rock material to enter the rotor and at least one outlet port through which the rock material is ejected. The crushing chamber of most VSI crushers is provided with a gate or door which allows access to the rotor body. The location of the crusher door is usually arranged such that it is not in the direct path of rock material ejected from the rotor body.

The rotor body includes a top plate and a bottom plate (also referred to as a base plate) arranged substantially horizontally such that they sandwich the vertically standing walls of the rotor. The wear parts are secured to the walls of the rotor. The top and base plates are typically substantially circular in plan view.

In a typical VSI crusher, the top plate includes the inlet port for rock material, the port being situated at the centre of the plate. This allows a gravity feed of rock material into the rotor.

The outlet port should be understood to mean the port by which rock material exits the rotor into the crushing chamber. In typical VSI crushers, the rotor has two or more outlet ports, situated around the circumference of the rotor. The outlet ports between the top and base plates and are usually defined at least partially by the vertical walls of the rotor. The vertical walls define the left and right sides of the outlet port.

At least some of the walls of the outlet port are positioned about or proximate the outer circumference of the rotor body such that they face substantially outwards, away from the centrally located inlet port.

Wear parts should be understood to mean the sacrificial components of the rotor that absorb the impact of rock material as it passes through the outlet ports, assisting in the breakdown of the rock material into aggregate. These wear parts may be known as rotor tips or cavity wear plates.

Reference shall now be made throughout the remainder of this specification to the wear parts being rotor tips, although this is not meant to be limiting. The present invention may be readily implemented with other types of wear parts, for example cavity wear plates, depending on their configuration and placement.

Depending on the configuration and placement of the rotor tips, they can also be used to retain a rock lining against the impact surfaces of the outlet port. A rock lining should be understood to mean a lining or coating of rock material along at least a portion of the outlet walls which absorbs the impact of rock material entering and exiting the rotor body.

It should be understood that rotor tip holders (or cavity blades in the case of cavity wear plates) are used in most crushers to hold the rotor tips in a fixed position. Reference shall now be made throughout the remainder of this specification to a rotor tip holder being a mounting bar. This is not meant to be limiting and the cavity blade may also be thought of as a mounting bar.

In some embodiments of the present invention, the mounting bar may be a fixed elongate column or pillar to either the top or bottom (base) plate of the rotor body, to which the wear parts are mounted as appropriate.

In preferred embodiments of the present invention, the mounting bar is configured to be removable from the rotor body.

The mounting bar is an elongate structure, configured with a head, a foot and a shaft. The length of the mounting bar is slightly longer than the distance between the top and bottom plates of the rotor body.

Typically the mounting bar will be configured from a suitably hard wearing and impact resistant material, such as Ni-Hard or Hi-Chrome (iron/chrome alloys), tungsten carbide or the like.

The head should be understood to engage with the top plate while the foot should be understood to engage with the base plate of the rotor body.

The shaft should be understood to be the portion of the mounting bar that connects or otherwise links the head and foot. In preferred embodiments of the present invention, the shaft forms the main body of the mounting bar.

In some embodiments of the present invention, the head may include a lateral protrusion from one or both sides of its head such that the head of the mounting bar has a larger cross-sectional area than the shaft of the mounting bar. This can help better locate and fix the mounting bar by its head relative to the top plate.

The top plate includes an aperture dimensioned to be complementary to the foot and shaft of the mounting bar. This is an important consideration of the present invention.

In some embodiments of the present invention, the aperture in the top plate may be tapered or stepped as it passes from the upper surface of the top plate to the underside of the top plate, such that the top surface of the head of the mounting bar sits flush with the top plate. This allows ancillary equipment to be freely positioned or otherwise secured to the top plate of the rotor body.

The base plate includes a recess or aperture, the size of the recess or aperture approximating the cross-section area of the foot of the mounting bar. Therefore, when the mounting bar is lowered through the top plate during its installation into the rotor body, its foot engages with the recess (or aperture) of the base plate. This provides additional stability for the mounting bar, but without the need for fastening devices.

In preferred embodiments of the present invention, the apertures in the top and base plates are substantially in vertical alignment with each other. Thus it will be appreciated that the head, shaft and foot of the mounting bar collectively take a substantially rod- or column-like shape.

However, it is not beyond the scope of the present invention that the apertures be offset from each depending on the configuration of the mounting bar, although any shape other than a substantially rod- or column-like shape may be difficult to pass through the aperture in the top plate.

In preferred embodiments of the present invention, the foot of the mounting bar has dimensioned to be approximately equal to or less than the cross-sectional area of the shaft of the mounting bar.

In preferred embodiments of the present invention, the recess or aperture may be of sufficient depth such that the foot sits flush with the base plate.

In some embodiments of the present invention, the foot may be configured with a protrusion extending laterally to one side. This helps with locating and maintaining the position of the mounting bar and its associated wear parts when in place. Preferably the protrusion is positioned to ensure that it faces away from the direction from which rock material contacts the tips.

It should be appreciated that the cross-sectional area of the foot, if provided with a protrusion, does not exceed the cross-sectional area of the aperture of the top plate. Otherwise, it may be difficult to pass the mounting bar through the top plate.

By positioning the mounting bar within the rotor of the VSI crusher such that its head is constrained by the top plate, and by holding the foot of the mounting bar in position, it will be appreciated that the mounting bar is generally held in position by its own weight, and without the use of fasteners.

Centrifugal forces that are applied to the mounting bar as the rotor body is spinning at high speeds also assist in ensuring the mounting bar remains in position during operation of the crusher.

It should be appreciated that the placement of the apertures in the top and bottom plates of the rotor are such that when in place, the rotor tips and mounting bar are not in the direct path of aggregate ejected from the outlet port of the rotor, but favours the left or right side of the outlet wall (depending on direction of rotation of the rotor body in use), proximate the outwardly facing vertical walls of the rotor.

It should be appreciated that in use, the centrifugal force of the rotor is such that rock material tends to ejected in a direction that is tangential to the direction of rotation of the rotor. This means that one side of the outlet port may be exposed to greater wear than the other.

In preferred embodiments of the present invention, the placement of the rotor tip is proximate to the walls of the outlet port exposed to the greater impact forces of the ejected rock material. However, in some embodiments of the invention, both the left and right sides of the exit of the outlet port may be provided with rotor tips.

The shaft of the mounting bar is configured pass through the rotor tip.

The rotor tip should be understood to have a body, with the body having an upper surface (which faces the top plate) and a lower surface (which faces the bottom plate).

A portion of the rotor tip body is configured to abut or otherwise contact a portion of the outlet port.

In preferred embodiments of the invention, the portion of the rotor tip body abuts an outwardly facing vertical wall of the outlet port.

In preferred embodiments of the present invention the contact surfaces of each component (rotor tip and outlet port) are flat although other configurations may be readily envisaged.

However, regardless of the configuration of the rotor tip and outlet port, it is important that the contact surfaces are complementary.

In preferred embodiments of the present invention, the rotor tips (or cavity wear plates as the case may be) are formed with a channel having an U-shaped cross-section.

The open portion of the U should be understood to define the mouth of the channel. It will be appreciated that the rotor tip is arranged such that the channel runs in a vertical orientation, from the upper surface of the body of the rotor tip to the lower surface of the rotor tip.

The deeper portion of the channel defines the locating portion, through which the mounting bar passes in order to fix the rotor tip relative to the rotor body. The locating portion of the channel is dimensioned to be complementary to the cross-section of the shaft of the mounting bar.

In some embodiments of the present invention, the mouth of the channel is narrower than the width of the shaft of the mounting bar.

This is an important consideration of the present invention. Persons skilled in the art will appreciate that due to the narrow mouth of the channel, the only way a mounting bar can be located within the rotor tip is by passing it through the top or bottom of the rotor tip.

However, in other embodiments of the invention, the mouth of the channel approximates the width of the shaft of the mounting bar. Because of the proximity of the vertical walls of the outlet port, and the wrap around nature of the rotor tip, the mounting bar traps the rotor tip against the outward facing vertical wall of that partially defines the outlet port, locking it in place without fasteners.

In yet another embodiment, the mouth of the channel is wider than the mounting bar. Rather than passing the mounting bar through the top plate from above, it can be passed through the aperture of the top plate from its underside (the side of the top plate which faces the base plate). This may require the mounting bar to be tilted into position, rather than simply being placed directly into position.

However, in this embodiment of the invention, the locating portion of the channel is still substantially similar in width to the mounting bar. Thus, it will be appreciated that the internal configuration of the channel approximates a V, as the mouth tapers inwardly towards the locating portion of the wear part.

In use, the rotor tip is configured such that the mouth faces outwards rather than facing the inlet port. This is so that the open portion of the rotor tip is not exposed to the impact forces of ejected aggregate material.

The mounting bar can be inserted through the aperture of the top plate of the rotor body. By raising it to a sufficient height, there will be sufficient clearance for the rotor tip to be located between the top and bottom plates. Persons skilled in the art will appreciate that the channel of the rotor tip needs to be in alignment with the aperture of the top plate and the recess or aperture of the bottom plate.

As the mounting bar is lowered, it passes through the locating portion of the channel until its foot is held by the recess or aperture. This effectively locks the rotor tip in place, with the mouth of the channel, and therefore the exposed portion of the mounting bar, facing outwards.

It will be appreciated that in this embodiment of the invention, ideally the foot of the mounting bar is not configured such that its footprint is large than that of the shaft of the mounting bar. This would ensure that the mounting bar can pass through the locating portion of the rotor tip easily.

However, in some embodiments the protrusion on the foot can be useful in anchoring the mounting bar, and in these embodiments, the protrusion may be orientated in the same direction as the mouth of the channel of the rotor tip.

In preferred embodiments of the present invention, the exterior surface of the bottom portion of the U-shaped cross-section is the contact surface of the rotor tip which abuts the outwards facing vertical wall that partially defines the outlet port. This is so that in use, the mounting bar locks the rotor tips against the wall of the outlet port, anchoring the tips in position.

In preferred embodiments, the bottom of the U-shaped cross-section may include a lateral projection, which assists in the alignment of the rotor tips and provides an additional surface to engage with the vertical walls of the outlet port.

In some embodiments of the rotor tip, a recess is provided running between the upper and lower surfaces of the body. An additional tip of tungsten carbide, for example, may be inserted and secured into the recess to further assist in the breakdown of rock material passing through and exiting the outlet port.

In these embodiments, the rotor tip including the additional tip of tungsten carbide is positioned proximate to the wall of the outlet port exposed to the most impact force of rock material exiting the rotor. A further rotor tip, but not necessarily one with the additional tungsten carbide tip, is positioned proximate the opposing wall.

In preferred embodiments of this invention, the rotor tip is segmented, and is formed by a plurality of U-shaped cross-section segments. This allows for the replacement of specific segments, depending on the rate of wear of a particular segment.

This is a useful feature as it will be appreciated that wear rate of the rotor tips will vary along its vertical length. The centre portion experiences the most impact from rock material, while the edges closest to the top and bottom plates experience the least.

Thus, by constructing the rotor tip such that it is formed from three or more separate segments allows the operator of the VSI crusher to rotate the segments for maximum efficiency. Rather than replace worn parts with new parts, semi-worn parts may be used instead.

The crusher incorporating the present invention may be used as a stand alone crusher or alternatively, may be incorporated into a stationary or mobile mineral material processing plant. A mobile mineral material processing plant should be understood to mean a heavy vehicle to which a crusher and ancillary equipment such as feed and discharge conveyors may be mounted.

The present invention offers a number of advantages of the prior art, including:

- easy replacement of wear parts through the door of the crushing chamber of a VSI crusher;
- facilitates easier maintenance of the rotor body if required;
- shortens the time in which a rotor must be offline in order to carry out maintenance, or
- at the very least, the present invention offers the public a useful choice.

BRIEF DESCRIPTION OF THE DRAWINGS

Further aspects of the present invention will become apparent from the ensuing description which is given by way of example only and with reference to the accompanying drawings in which.

BEST MODES FOR CARRYING OUT THE INVENTION

Figure 1A:
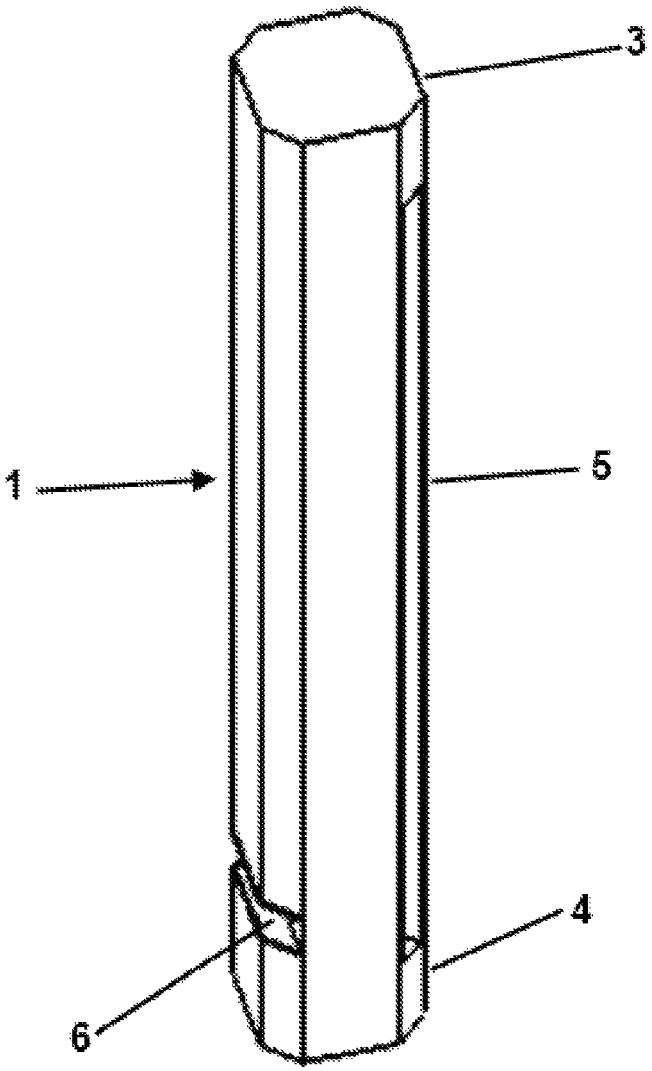
FIG. 1*a-b* is a perspective view of the mounting bar and associated wear part according to one embodiment of the present invention.
Figure 1B:
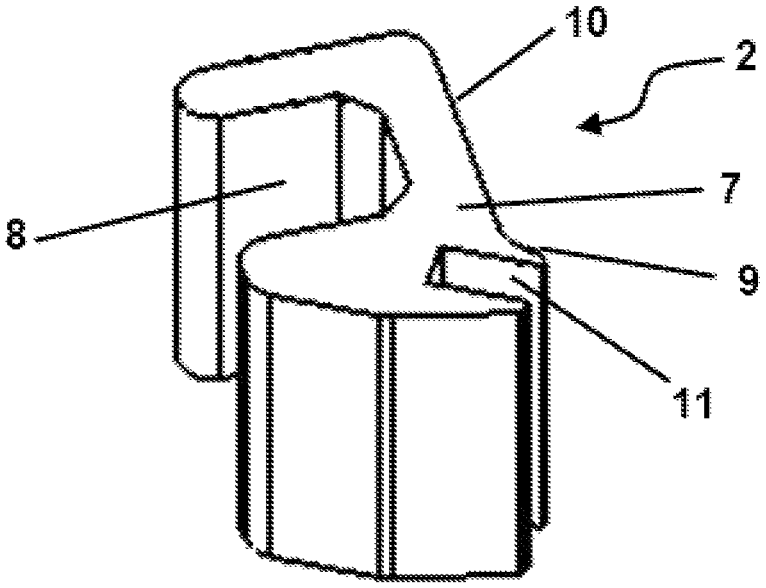

The present invention is depicted in FIGS. 1*a* and 1*b*, which illustrates the mounting bar (generally indicated by arrow 1) and a wear part (2) for use with the mounting bar respectively.

The mounting bar (1) includes a (3) head, foot (4) and shaft (5).

It will be noted that the cross-sectional area of the mounting bar is substantially constant from top to bottom but this is not strictly a requirement of the present invention. In some embodiments of the mounting bar (not illustrated), the head may be dimensioned such that it has a larger cross-sectional area than the shaft and foot of the mounting bar.

The shaft (5) is provided with a recess (6) across its width. This provides a surface by which the user can grip or otherwise hold the mounting bar (1) using their fingers or perhaps a specialist tool.

The wear part (2) is formed largely with a U-shaped cross-section (7), which defines a channel (8) and a lateral projection (9) which helps locate the wear part (2) in use.

The exterior surface (10) of the portion of the wear part that defines the base of the U in the wear part is configured to abut one the outward facing vertical wall of the rotor assembly (not shown). The interior of the channel (8) approximates the width of the mounting bar (not shown).

The lateral projection (9) of the wear part (2) is configured with a recess (11) into which a tip of tungsten carbide or the like may be inserted, which assists with the breakdown of rock material (not shown) contacting the wear part (2).

Figure 2A:
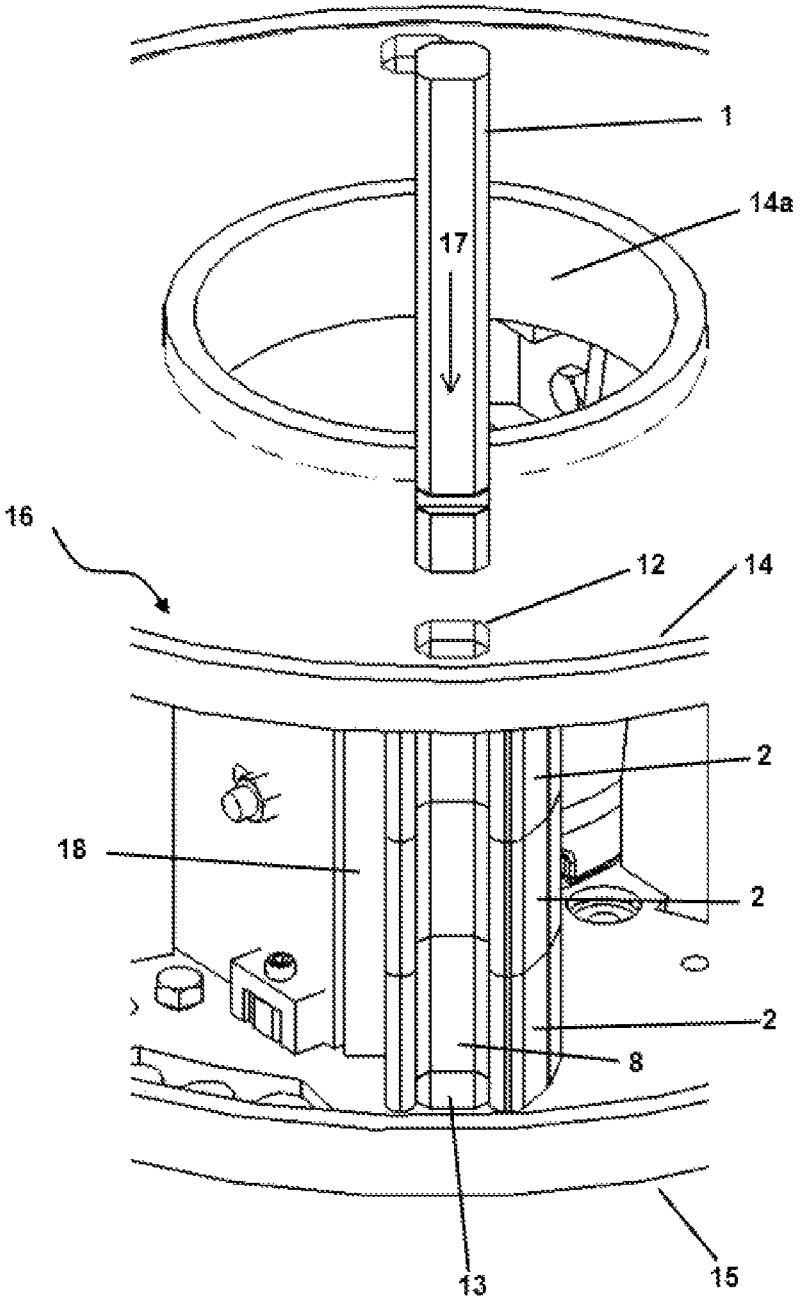
FIGS. 2*a-b* are perspective views of the invention, as illustrated in FIGS. 1*a-b*, in use with a rotor body.

In use, as shown in FIG. 2*a*, wear parts (2) are stacked up in alignment with the apertures (12, 13) of the top (14) and bottom (15) plates of the rotor (16) of the VSI crusher (not shown).

Once the wear parts (2) are in position, the mounting bar (1) can then be lowered (in the direction of arrow (17) through the channel (8) of the wear parts, effectively trapping them against the outwardly facing vertical wall (18) of the rotor (16).

This wall (18) defines one side of the outlet port, and in some embodiments, another set of wear parts will protect the other side (not visible in this view) of the outlet port. It will be noted that the apertures (12, 13), and therefore the mounting bar, are proximate the wall of the rotor so as to not be in the direct path of rock material (not shown) being ejected from the rotor (16).

No fasteners are required to secure the wear parts (2) to the mounting bar (1). It should be appreciated that the mounting bar (1) (and the open portion of the rotor tips (2)) is orientated to face outwards, away from the inlet port (14*a*) of the top plate (14) surfaces that will be directly contacted by rock material (not shown). This would expose these areas to unnecessary wear and tear, and may lead, because the loss of structural integrity due to the edges of the channel, to premature mechanical failure of the overall wear part assembly (1, 2).

Figure 2B:
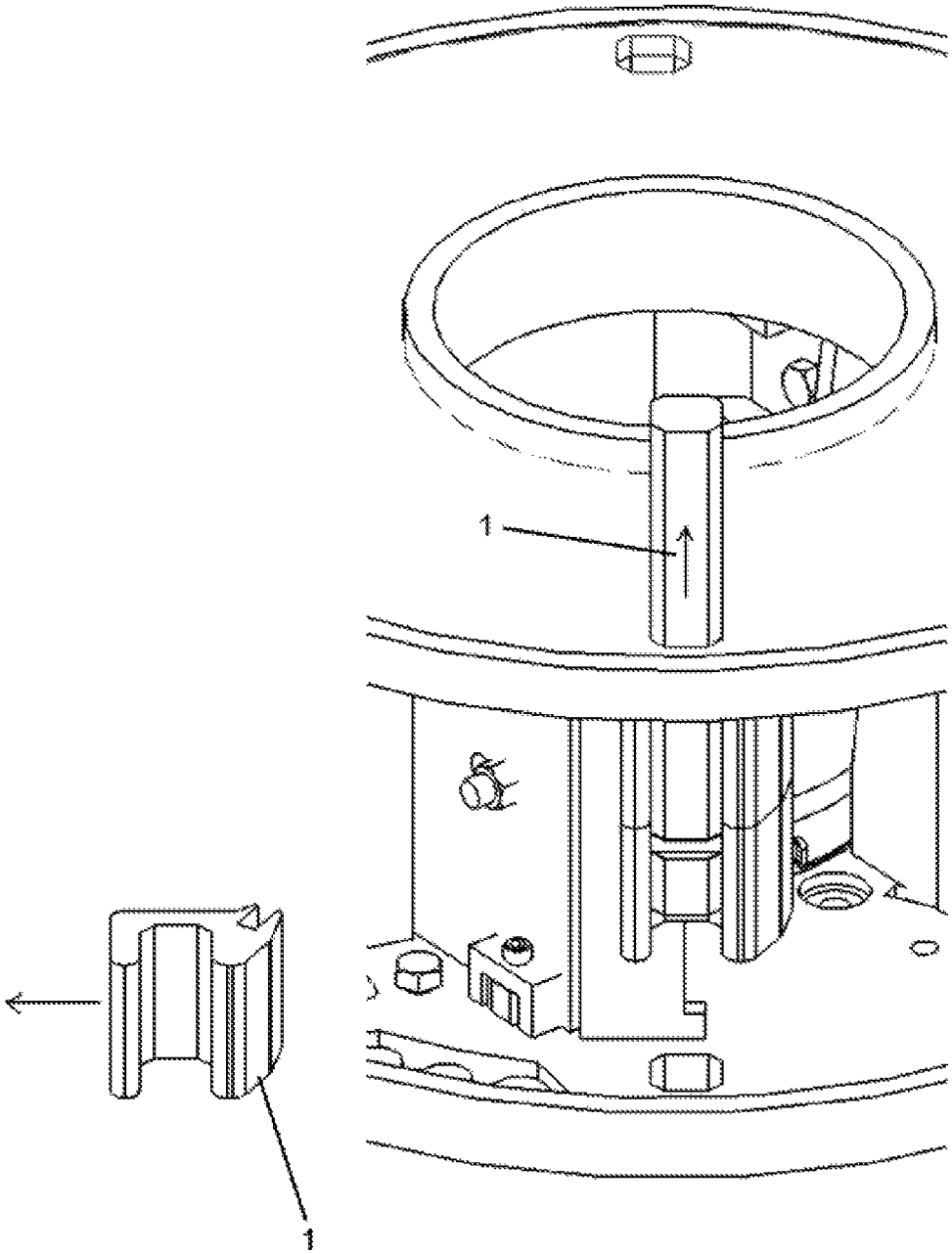

As wear parts (2) deteriorate through use, it may become necessary to replace one or more of them, as depicted in FIG. 2*b*

To effect this, the mounting bar (1) simply needs to be levered upwards (using fingers or a tool to engage with the recess of the mounting bar). When raised to a sufficient height relative to the wear part (2) requiring replacement, the wear part (2) can simply be removed and replaced as appropriate. This allows for the straight forward replacement of the wear parts through the inspection door of the crusher (not shown).

Figure 3A:
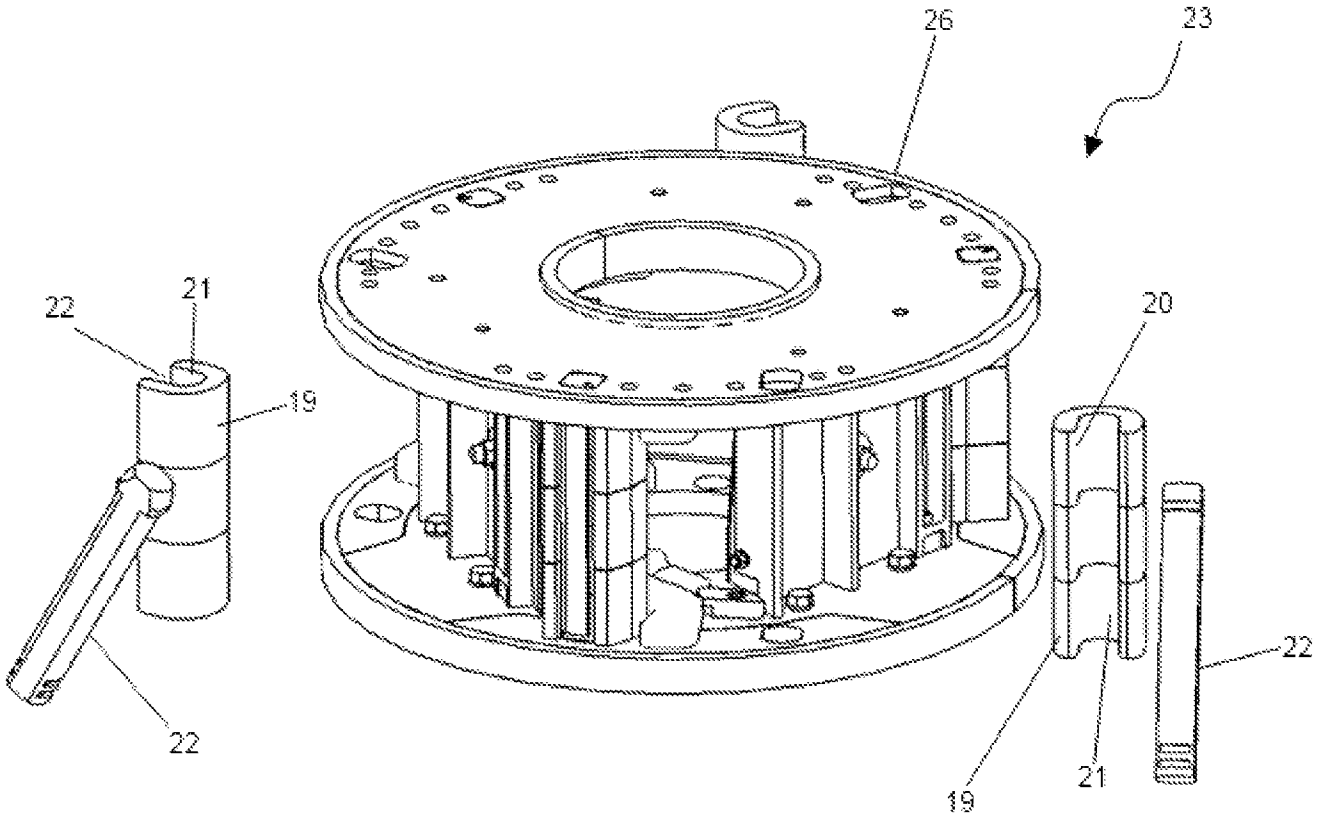
FIGS. 3*a-c* are perspective views of an alternative embodiment of the invention in use with a rotor body.
Figure 3B:
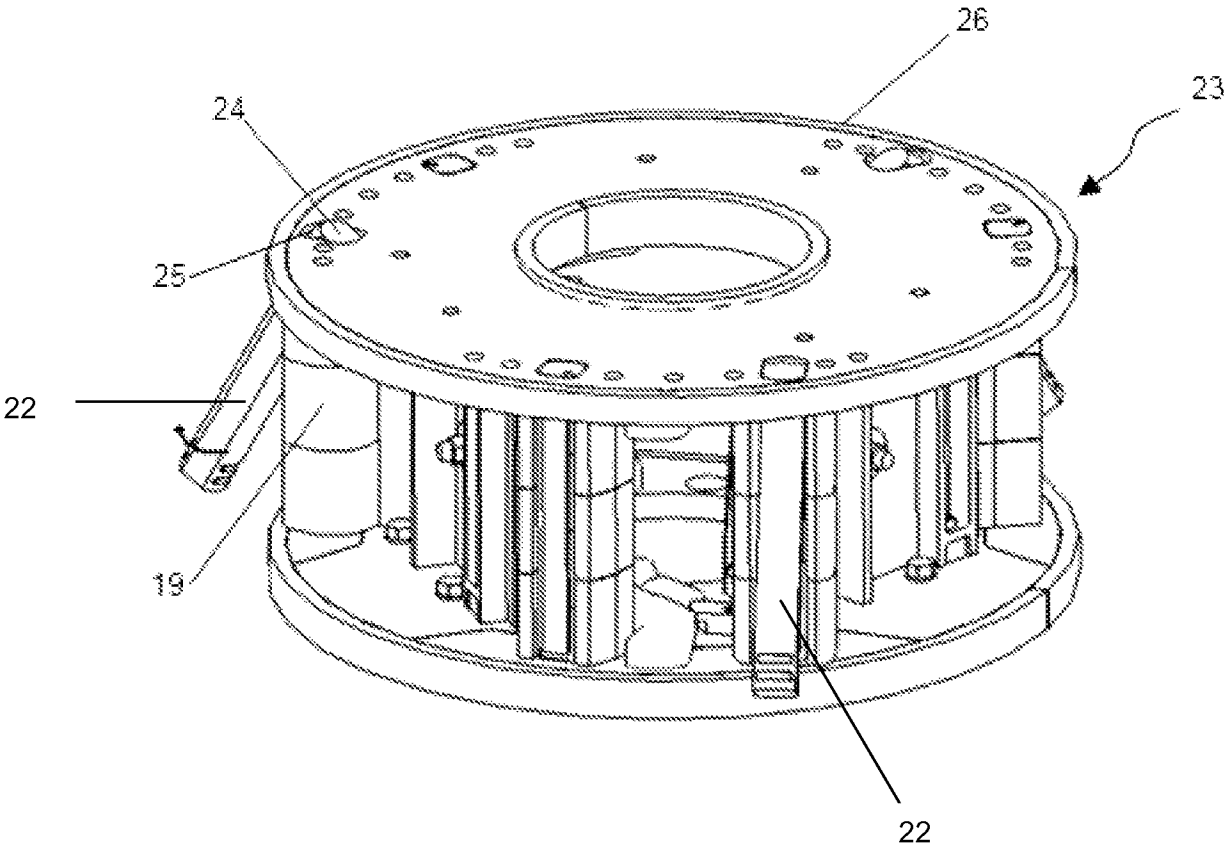
Figure 3C:
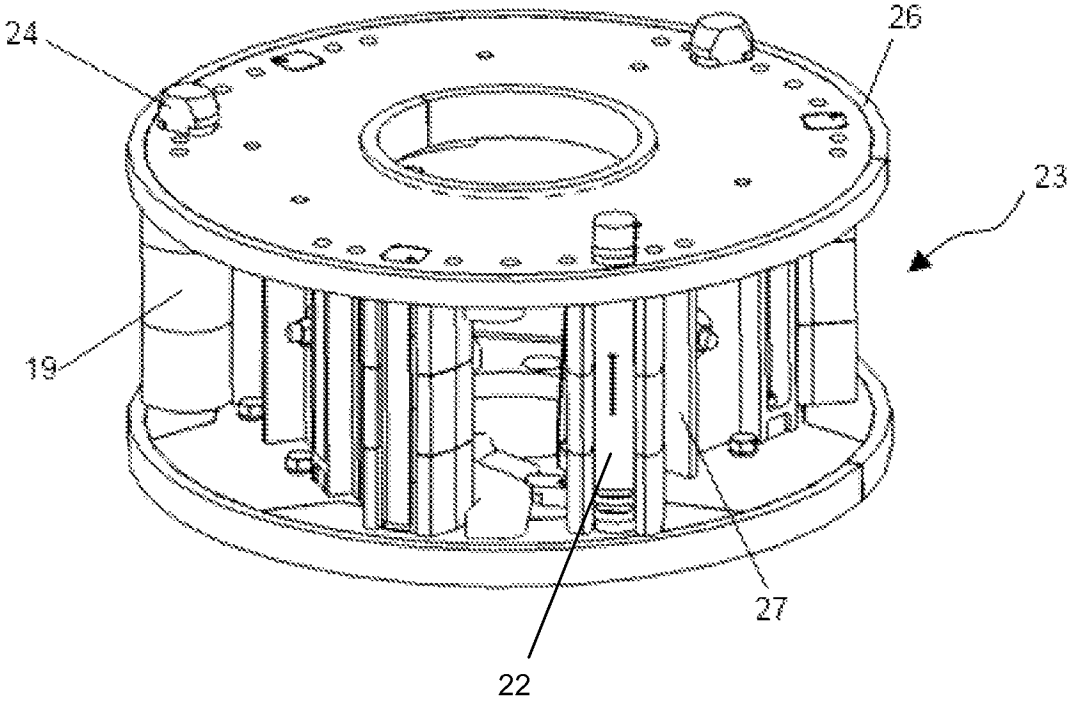

An alternative embodiment of the invention is illustrated in FIGS. 3*a* to 3*c*.

In this embodiment, the wear part (19) is configured with a wider mouth (20) than those previously illustrated, the mouth tapering inwards towards the locating portion (21) of the wear part. The mouth (20) is wider than the width of the mounting bar (22).

The wear parts (19) may be stacked (three segments are depicted) up in position on the rotor body (23) as illustrated in FIG. 3*b*, and the mounting bar (22) offered up to the wear parts. The mounting bar (22) is tilted away from the vertical to allow its head (24) to pass through the aperture (25) in the top plate (26) of the rotor body (23).

In FIG. 3*c*, the mounting bar (22) is tilted back to the vertical, with the head (24) passing through the top plate (26). The rotor tips are wedged in position against the vertical walls of the outlet port (27) of the rotor. Like the previous embodiment described, no fasteners are required.

Figure 4A:
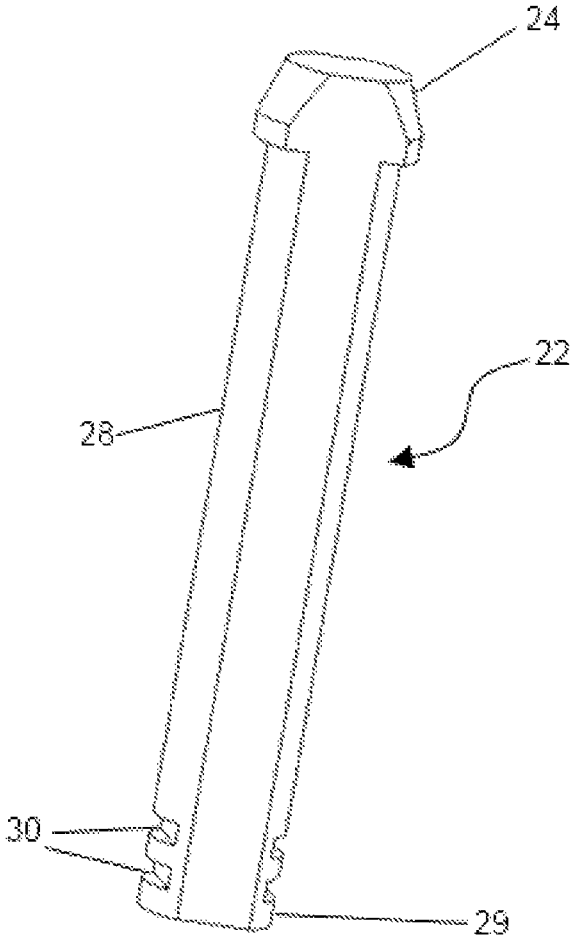
FIG. 4*a-b* is a perspective view of an alternative embodiment of the mounting bar and associated wear part.
Figure 4B:
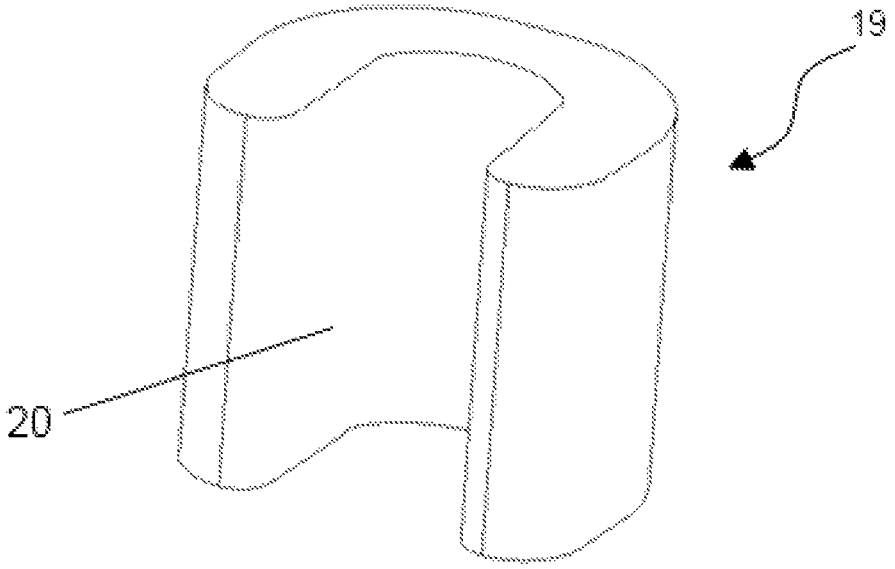

FIGS. 4*a* and 4*b* is a perspective view of the mounting bar and wear part depicted in FIGS. 3*a* to 3*b*. The mounting bar (22) has a more defined head (24) but like the other embodiment described has a shaft (28) and a foot (29) but with a pair of recesses (30). The wider mouth (20) of the wear part (19) is more clearly seen.

Figure 5:
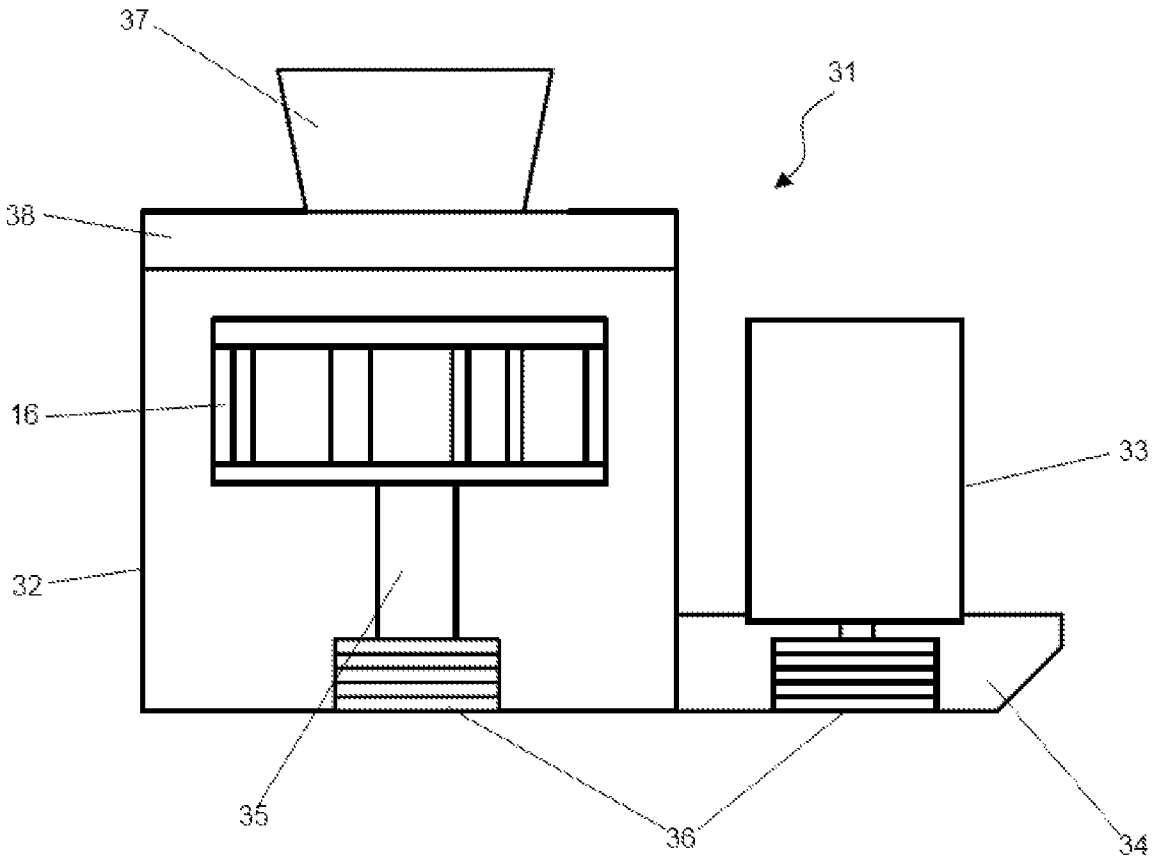
FIG. 5 is a side view of a crusher including the rotor body of the present invention.

Turning now to FIG. 5, this depicts a crusher (31) which includes the rotor body (16) housed within a frame (32). The crusher (31) is driven by a motor (33) mounted to a frame (34). Both the motor (33) and the rotor shaft (35) are provided with pulleys (36).

Rock material (not shown) enters the crusher (31) via a feeder hopper (37) mounted to the roof (38) of the crusher (31).

Figure 6:
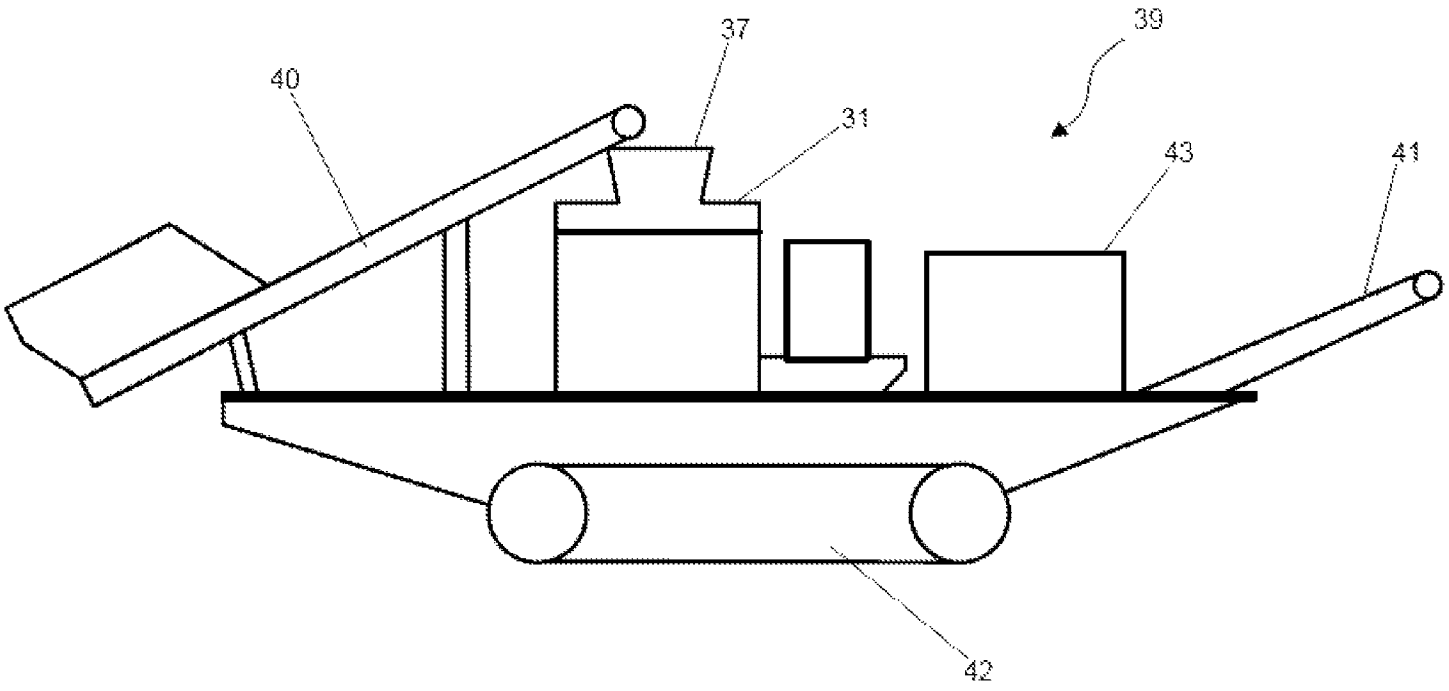
FIG. 6 is a side view of a mobile mineral material processing plant.

FIG. 6 shows the crusher (31) as part of a mobile mineral processing plant (39).

The plant (39) includes a feeding device (40) to conduct rock material (not shown) to the feeder hopper (37) of the crusher (31). As the rock material is processed, it exits the plant (39) via a discharge conveyor (41).

The plant (39), mounted to a tracked propelling means (42), is operable via a control unit (43) which controls the crusher (31) and its ancillary equipment such as the feeding device (40). It should be appreciated that instead of, or in addition to, tracks the plant (39) may include wheels, runners or legs.

Aspects of the present invention have been described by way of example only and it should be appreciated that modifications and additions may be made thereto without departing from the scope thereof as defined in the appended claims.

What we claim is:

1. A wear part assembly for a rock crusher, wherein the crusher includes a rotor body having an inlet port, a top plate and a bottom plate and at least one outlet port between the plates, the assembly comprising:

at least one wear part, wherein the wear part includes a body having an upper surface and a lower surface, the body also including an exterior surface;

a mounting bar configured for use with the at least one wear part, wherein the mounting bar includes a head and a shaft wherein the shaft is dimensioned to pass through a locating portion of the wear part, wherein the wear part is configured with a channel running between the upper surface and the lower surface of the body, the channel having a mouth and a locating portion, wherein the locating portion is complementary to the width of the mounting bar, wherein the mouth of the channel is narrower than a width of the shaft of the mounting bar, wherein the exterior surface of the body is configured to abut a substantially vertical surface of the outlet port such that, in use, the mouth of the wear part faces substantially away from the inlet port.

2. The wear part assembly of claim 1 wherein the foot of the mounting bar engages with the bottom plate of the rotor body of the rock crusher.

3. The wear part assembly as claimed in claim 1 wherein the wear part is segmented.

4. The wear part assembly as claimed in claim 1 wherein the wear part is a rotor tip.

5. The wear part assembly as claimed in claim 1 wherein the wear part is a cavity wear plate.

6. The wear part assembly of claim 1 wherein the head of the mounting bar engages with the top plate of the rotor body of the rock crusher.

7. The wear part assembly of claim 1 wherein the mounting bar includes a foot.

8. A rock crusher, the crusher including a rotor, wherein the rotor includes:

at least one wear part, wherein the wear part includes a body having an upper surface and a lower surface, and wherein the body also includes an exterior surface;

a mounting bar for the wear part;

a top plate, wherein the top plate includes an aperture for the mounting bar;

a bottom plate;

an inlet port; and at least one outlet port between the plates, wherein the wear part is configured with a channel running between the upper surface and the lower surface of the body, the channel having a mouth and a locating portion, wherein the locating portion is complementary to the width of the mounting bar, and wherein the exterior surface of the body is configured to abut a substantially vertical surface of the outlet port such that, in use, the mouth of the wear part faces substantially away from the inlet port.

9. A rotor for a rock crusher, wherein the rotor includes:

at least one wear part, wherein the wear part includes a body having an upper surface and a lower surface and wherein the body also includes an exterior surface;

a mounting bar for the wear part;

a top plate, wherein the top plate includes an aperture for the mounting bar, and a bottom plate, an inlet port; and at least one outlet port between the plates, wherein the wear part is configured with a channel running between the upper surface and the lower surface of the body, the channel having a mouth and a locating portion, wherein the locating portion is complementary to the width of the mounting bar, and wherein the exterior surface of the body is configured to abut a substantially vertical surface of the outlet port such that, in use, the mouth of the wear part faces substantially away from the inlet port.

10. A mineral material processing plant, wherein the plant includes the rock crusher of claim 8.

11. A method of assembling a wear part assembly for use in a rotor for a rock crusher, wherein the rotor includes a top plate, the top plate configured with an aperture for a mounting bar, and a bottom plate, an inlet port and an outlet port the wear part assembly including:

a wear part, wherein the wear part includes a body having an upper surface and a lower surface and is configured with a channel running between the upper surface and the lower surface of the body, the channel having a mouth and a locating portion, and wherein the exterior surface of the body is configured to abut a substantially vertical surface of the outlet port such that, in use, the mouth of the wear part faces substantially away from the inlet port;

a mounting bar, wherein the mounting bar includes a head and a shaft, wherein the shaft is dimensioned to pass through the locating portion of the channel of the wear part, the method comprising the steps of:

a) placing the wear part between the top and base plates of the rotor and abutting the vertical surface of the outlet port such that the channel of the body of the wear part is substantially in vertical alignment with the aperture of the top plate, and b) passing the mounting bar through the aperture of the top plate and into the locating portion of the channel, thereby locking the wear part in place relative to the rotor.

12. A method of assembling a wear part assembly for use in a rotor for a rock crusher, wherein the rotor includes a top plate, the top plate configured with an aperture for a mounting bar and wherein the aperture runs between an upper surface of the top plate and a lower surface of the top plate, and a bottom plate, an inlet port and an outlet port the wear part assembly including:

a wear part, wherein the wear part includes a body having an upper surface and a lower surface and is configured with a channel running between the upper surface and the lower surface of the body, the channel having a mouth and a locating portion, and wherein the exterior surface of the body is configured to abut a vertical surface of the outlet port such that, in use, the mouth of the wear part faces substantially away from the inlet port;

a mounting bar, wherein the mounting bar includes a head and a shaft, wherein the shaft is dimensioned to pass through the locating portion of the channel of the wear part, the method comprising the steps of:

a) placing the wear part between the top and base plates and abutting the vertical surface of the outlet port of the rotor such that the channel of the body of the wear part is substantially in vertical alignment with the aperture of the top plate, and b) tilting the mounting bar away from the vertical and passing the head of the mounting bar through the aperture of the top plate from its lower surface, and c) tilting the mounting bar towards the vertical and into the locating portion of the channel, thereby locking the wear part in place relative to the rotor.

* * * * *